United States Patent [19]

Carter et al.

[11] Patent Number: 4,761,222

[45] Date of Patent: Aug. 2, 1988

[54] METHOD FOR SEPARATING NORMALLY LIQUID ORGANIC COMPOUNDS

[75] Inventors: Cecil O. Carter, Wann, Okla.; Daniel M. Coombs, Borger, Tex.

[73] Assignee: Phillips Petroleum Company, Bartlesville, Okla.

[21] Appl. No.: 60,965

[22] Filed: Jun. 16, 1987

Related U.S. Application Data

[63] Continuation of Ser. No. 811,192, Dec. 20, 1985, abandoned.

[51] Int. Cl.[4] ..... C10G 21/16; C10G 21/28

[52] U.S. Cl. ..... 208/322; 208/321; 208/323; 208/324; 208/339; 585/803; 585/804; 585/811; 585/835

[58] Field of Search ..... 208/321, 322, 323, 324, 208/311, 339, 336, 337, 96, 348; 585/804, 811, 835

[56] References Cited

U.S. PATENT DOCUMENTS

| | | | |
|---|---|---|---|
| 2,936,283 | 5/1960 | Hutchings | 208/321 |
| 2,956,088 | 10/1960 | Krewer et al. | 208/321 |
| 3,082,270 | 3/1963 | McKinnis | 208/321 |
| 3,385,784 | 5/1968 | Okuma et al. | 208/321 |
| 3,487,013 | 12/1969 | Van Tassell | 208/321 |
| 3,539,503 | 11/1970 | Benham | 208/323 |
| 3,567,626 | 3/1971 | Bozeman et al. | 208/316 |
| 3,595,781 | 7/1971 | Navarre et al. | 208/321 |
| 3,714,033 | 1/1973 | Somekh et al. | 208/321 |
| 3,714,034 | 1/1973 | Kosseim et al. | 208/323 |
| 4,168,226 | 9/1979 | White et al. | 208/321 |
| 4,179,362 | 12/1979 | Irani et al. | 208/321 |
| 4,267,034 | 5/1981 | Carter | 208/323 |
| 4,401,560 | 8/1983 | Vidueira et al. | 208/333 |
| 4,419,226 | 12/1983 | Asselin | 208/322 |
| 4,493,765 | 1/1985 | Long et al. | 208/321 |
| 4,544,796 | 10/1985 | Kurek et al. | 208/322 |

*Primary Examiner*—Anthony McFarlane
*Attorney, Agent, or Firm*—Michael E. Wilson

[57] ABSTRACT

A mixture of normally liquid organic compounds, particularly a light cycle oil obtained by the catalytic cracking of petroleum oils, is separated by contacting the mixture with an essentially anhydrous organic sulfoxide, particularly dimethylsulfoxide, to dissolve an organic extract in said sulfoxide and form an extract phase, comprising sulfoxide and the organic extract, and a raffinate phase, comprising the organic raffinate; diluting the extract phase with about 4.0 to 10.0 wt. % of water; separating the diluted extract phase into an aqueous phase, comprising the water containing the sulfoxide dissolved therein, and an organic phase, comprising the organic extract with minor amounts of the sulfoxide and water; fractionating the organic phase to separate the water and sulfoxide from the organic extract, which is suitable for use as a flotation agent; recycling the thus separated water and sulfoxide to the dilution step; drying the aqueous phase to remove the water and produce an essentially anhydrous sulfoxide; and recycling the sulfoxide to the solvent extraction step.

5 Claims, 1 Drawing Sheet

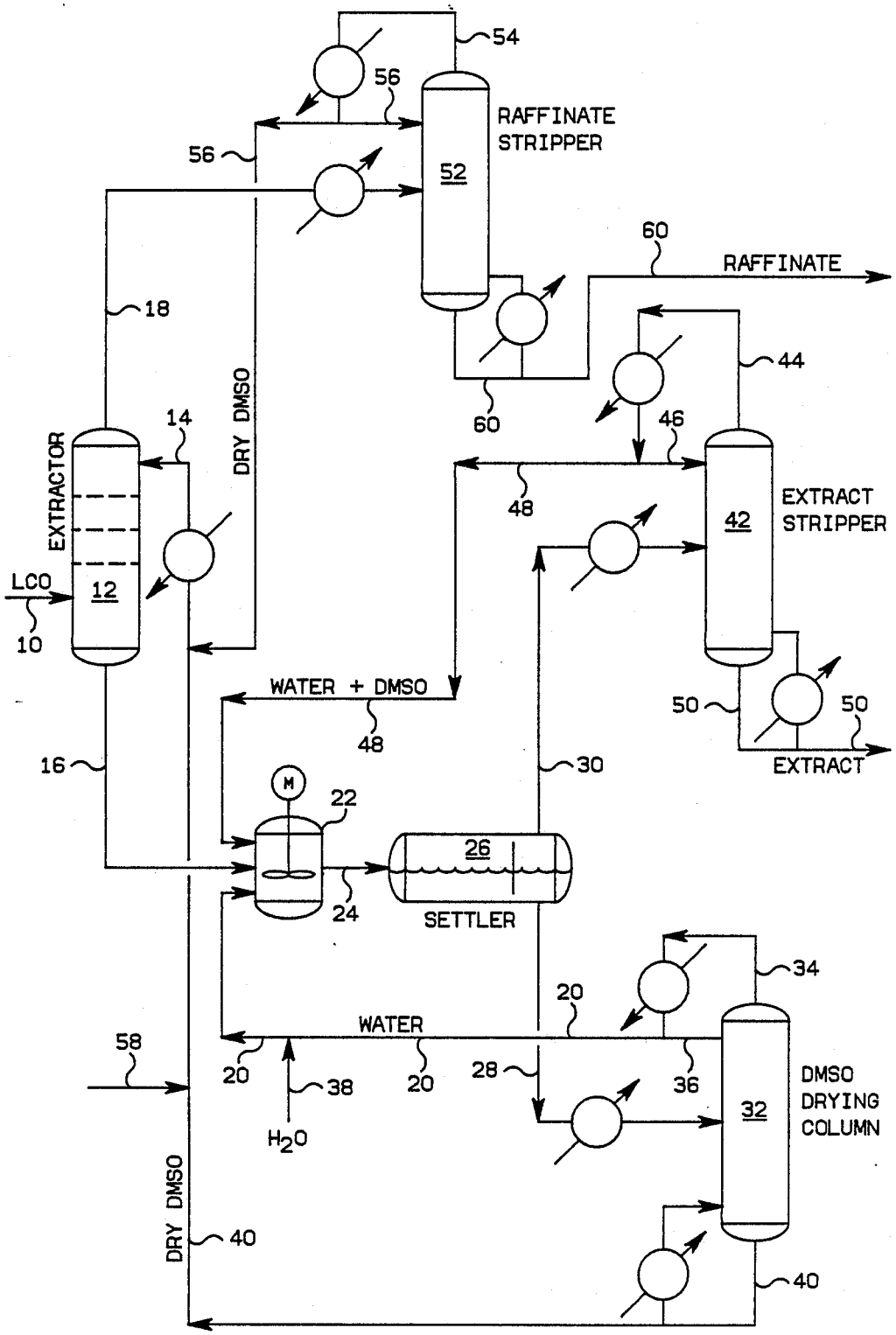
54
56
RAFFINATE
STRIPPER
56
52
60
RAFFINATE
18
44
DRY DMSO
14
60
46
EXTRACTOR
48
EXTRACT
STRIPPER
42
LCO
12
10
WATER + DMSO
50
50
48
EXTRACT
16
30
M
22
26
24
SETTLER
34
20
WATER
58
20
38
20
28
36
DMSO
DRYING
COLUMN
32
H2O
DRY DMSO
40
40

METHOD FOR SEPARATING NORMALLY LIQUID ORGANIC COMPOUNDS

This application is a continuation of application Ser. No. 811,192 filed on Dec. 20, 1985, now abandoned.

The present invention relates to a method for separating a mixture of normally liquid organic compounds. In a more specific aspect, the present invention relates to a method for separating a mixture of normally liquid hydrocarbons. In a still more specific aspect the present invention relates to a method for separating a light cycle oil obtained by cracking a hydrocarbon mixture. Still more specifically, the present invention relates to a method for separating the light cycle oil obtained by cracking a hydrocarbon mixture, by extraction with an organic sulfoxide to produce a raffinate fraction comprising a diesel fuel of improved cetane number and an extract fraction comprising a flotation agent.

BACKGROUND OF THE INVENTION

In the art of separating mixtures of organic compounds, it is relatively easy to separate such mixtures into fractions having specified boiling ranges by fractional distillation and the like. However, it is substantially more difficult to separate such mixtures into individual chemical structural types of compounds of fractions enriched in particular structural compounds. This, of course, is due to the fact that many structurally different compounds have the same or nearly the same boiling points. Consequently, it has become common practice to separate structurally different compounds of a mixture by employloying solvent extraction, utilizing solvents which are selective for compounds having a particular type or types of chemical structure from other compounds having different chemical structures. One such group of solvents is organic sulfoxides. While organic sulfoxides have heretofore been suggested as a general solvent for separations of hydrocarbons, oxyorganic mixtures and the like, the commercial use of such solvents has been quite limited. This limited use of organic sulfoxides, as solvents, is due to the substantial expense of utilizing such solvents, primarily because large volumes of solvent are required and effective means for recovering the solvent for reuse have not been particularly effective or are highly energy intensive. This is particularly true where both the extract fraction and the raffinate fraction are normally liquid materials.

The above-mentioned problems are particularly prevalent in the petroleum refining art. Crude oils can be grossly separated into fractions having predetermined boiling ranges, for example, normally gaseous hydrocarbons, crude naptha, heavy naptha, middle distillates, gas oil fractions and tar fractions. However, in most cases, these various fractions must be subjected to further thermal and catalytic conversion processes in order to produce useful products. For example, the napthas are treated and/or converted to gasoline and solvent products; the middle distillates to kerosene and furnace oils and the gas oil and tar to lighter products which, in turn, must be further treated or converted to end products. Most such conversion processes, in turn, create their own problems of separating the materials into useful end products, such as gasolines, furnace oils, diesel oils and chemical process feedstocks. For example, gas oil fractions of crude oil are generally subjected to thermal or catalytic cracking in the presence of an acidic catalyst such as silica-alumina. Catalytic cracking produces a gas fraction, a naptha fraction or fractions, a light fuel oil, commonly referred to as light cycle oil, and heavy gas oils, commonly referred to as heavy cycle oil. While fractional distillation can be utilized to separate catalytic cracking products, in accordance with the boiling point range, in order to produce the most useful and valuable products, it is necessary to further separate some of these materials into fractions enriched in hydrocarbons having particular chemical structures. The present invention is particularly related to the separation of light cycle oil into more useful and valuable products.

Organic sulfoxides, particularly dimethylsulfoxide, have heretofore been utilized for separation of light cycle oils into more valuable component fractions. However, such extraction processes are fraught with the same problems, previously mentioned, with respect to the separation of normally liquid organic compounds with organic sulfoxides, namely, the requirement of substantial volumes of organic sulfoxide and inefficient or highly energy intensive techniques for recovering the solvent. In such processes, it is conventional practice to utilize vacuum distillation, azeotropic distillation and the like to recover the organic sulfoxide from the dissolved extract fraction. However, such distillation techniques are highly energy intensive and significant amounts of solvent are carried over with the extract fraction. It would, therefore, be highly desirable to provide an improved technique for separating the organic sulfoxide from the extract fraction and, particularly, to provide such a process which reduces the energy requirements of separation.

SUMMARY OF THE INVENTION

It is therefore an object of the present invention to provide an improved method for the separation of normally liquid organic compounds which overcome the above and other problems of the prior art. Another object of the present invention is to provide an improved process for the separation of a mixture of normally liquid organic compounds by solvent extraction with organic sulfoxides. A further object of the present invention is to provide an improved method for separating a light cycle oil, utilizing organic sulfoxides as a solvent. A still further object of the present invention is to provide an improved method for separating a light cycle oil obtained by cracking the hydrocarbon mixture, utilizing organic sulfoxide as a solvent. Another and further object of the present invention is to provide an improved method for separating a mixture of organic compounds, utilizing organic sulfoxides as a solvent, and recovering the solvent from the extract fraction. Yet another object of the present invention is to provide an improved method for separating a mixture of normally liquid organic compounds, utilizing organic sulfoxides as a solvent, and separating the solvent from the extract fraction more effectively. A still further object of the present invention is to provide a process for separating a mixture of normally liquid organic compounds, utilizing organic sulfoxide as a solvent, and separating the solvent from the extract fraction with a minimal expenditure of energy.

In accordance with the present invention, a mixture of normally liquid organic compounds is separated by contacting the mixture with an essentially anhydrous organic sulfoxide, under conditions sufficient to dissolve a portion of the organic compounds in the sulfoxide to form an extract phase, containing the sulfoxide and the thus extracted portion of the organic compounds, and produce a raffinate phase, comprising the remainder of the organic compounds; adding between about 4.0 and 10.0 wt. % of water to the extract phase; separating an organic phase, comprising a minor portion of the water, said extracted organic compounds and a minor portion of the sulfoxide, from an aqueous phase, comprising the remaining major portion of the sulfoxide and the remaining major portion of the water; fractionating the organic phase, under conditions sufficient to separate the water and sulfoxide, as a vapor phase, from the extracted organic compounds, as a liquid phase; recycling the vapor phase to the water addition step; drying the aqueous phase, under conditions sufficient to remove the water and produce an essentially anhydrous sulfoxide; and recycling the anhydrous sulfoxide to the solvent contacting step. To the extent that minor amounts of the sulfoxide are present in the raffinate phase, the raffinate phase is fractionated, under conditions sufficient to separate the sulfoxide from the raffinate. In a preferred embodiment, the mixture of organic compounds is a light cycle oil obtained by the catalytic cracking of petroleum oils and the sulfoxide is dimethylsulfoxide.

BRIEF DESCRIPTION OF THE DRAWING

The single FIGURE of drawings is a schematic flow diagram, illustrating a system for practicing the method of the present invention.

DESCRIPTION OF THE PREFERRED EMBODIMENTS

The following description will be confined to the separation of a light cycle oil, derived from catalytically cracking a petroleum oil utilizing dimethyl sulfoxide as a solvent, which method represents the best mode of practicing the present invention. However, it should be recognized that the present invention is also useful for the separation of other mixtures of normally liquid organic compounds, other hydrocarbon mixtures, mixtures of oxyorganic compounds and the like, provided only that a portion of the mixture is separable by solvent extraction with an organic sulfoxide. Similarly, the present invention may be practiced utilizing any organic sulfoxide known in the art as a solvent or mixtures of organic compounds since dimethyl sulfoxide is suggested for use based primarily on its availability and cost.

In the drawing, a light cycle oil, obtained by the catalytic cracking of petroleum oil, is introduced through line 10 to extractor 12. Essentially anhydrous dimethylsulfoxide is introduced to extractor 12 through line 14. Extractor 12 can be any suitable liquid-liquid extraction apparatus. Any convenient mode of contact such as batch or continuous can also be utilized. Continuous countercurrent contacting is preferred. The operating conditions in contactor 12 can be any combination of conditions which affect the desired result. The ratio of dimethyl sulfoxide to feed will depend in part upon the composition of the feed and can be any ratio between about 10/1 and 200/1. The temperature of contacting may vary between ambient temperature and about 120° F. and the pressure may be anywhere between ambient and about 500 psia.

The extract phase, which generally comprises aromatic and olefinic hydrocarbons and the dimethylsulfoxide, is discharged from extractor 12 through line 16. The raffinate phase, discharged through line 18, comprises the remainder of the light cycle oil and is essentially a diesel oil having an improved cetane number. In practice, it has been found that the raffinate phase, passing through line 18, will contain between about 4 and 8wt. % of dimethylsulfoxide, which can be recovered as set forth hereinafter.

In accordance with the present invention, the dimethylsulfoxide is effectively and economically separated from the extracted portion of the light cycle oil by adding water, through line 20, in an amount sufficient to produce a mixture of water, dimethylsulfoxide and light cycle oil extract containing between about 4.0 and 10.0 wt. % of water in mixer 22. This mixture is discharged through line 24 to a liquid-liquid separator or settler 26. The mixture is separated into an aqueous phase, containing dimethyl sulfoxide, which is discharged through line 28 and an organic phase, comprising the light cycle oil extract with minor amounts of water and dimethylsulfoxide. The water dilution and settling steps can comprise any convenient mixing and settling apparatus, whether batch or continuous. Any suitable conditions of time, temperature or pressure, etc., which will provide the desired degree of separation between the organic extract and the aqueous solution of sulfoxide, can also be utilized. Pilot plant studies of the process of the present invention have demonstrated that dilution of the extract phase with about 4.0 wt. % of water will recover about 50% of light cycle oil extract from the mixture. However, by diluting the mixture with about 7.0 wt. % of water, 88.5 wt. % of the light cycle oil extract was recovered and at dilution rates in excess of about 10 wt. % of water, insignificant amounts of additional light cycle oil extract were recovered.

The aqueous phase, containing the dimethylsulfoxide, is then passed to dimethylsulfoxide drying column 32. The dimethylsulfoxide drying column may be any suitable apparatus for separating water from dimethylsulfoxide and is conveniently a fractional distillation column. Overhead vapor stream from column 32 is discharged through line 34. A portion of the condensed overhead may be passed through line 36 as a reflux in column 32. All of the remainder of the condensed overhead may be recycled to the water dilution step through line 20. Make up water for the dilution step may be introduced through line 38. The liquid phase from column 32, comprising essentially anhydrous dimethylsulfoxide, is recycled to extractor 12 through line 40. For most effective extraction with dimethylsulfoxide, the dimethylsulfoxide should be essentially anhydrous and contain less than about 1.0 wt. % of water and preferably below about 0.5 wt. % of water.

The light cycle oil extract passing through line 30 from settler 26, contains small amounts of dimethylsulfoxide and water. In order to remove the latter components from the extract, the extract is passed to extract stripper 42. Extract stripper 42 may be any convenient separator, such as a fractional distillation column capable of separating the residual amounts of water and dimethylsulfoxide from the light cycle oil extract. The vapor phase overhead from column 42 is discharged through line 44 and condensed. A portion of the condensed overhead may be passed through line 46 as a reflux for column 32. All or a portion of the overhead from column 42 comprising water and dimethylsulfoxide is passed through line 48 as a recycle to the dilution and mixing step 22–26. It is to be noted, at this point, that the water added through lines 48 and 20, respectively, together with any makeup water introduced through line 38 are cumulatively utilized to determine the amount of dilution, with water, of the extract phase. The liquid phase from column 42 is discharged through line 50 as the extract product of the process. This extract product contains essentially aromatic and olefinic portions of the light cycle oil and is particularly useful as a flotation agent.

As previously indicated, the light cycle oil raffinate from extractor 12 contains residual amounts of dimethyl sulfoxide. Consequently, it is preferred that this solvent be recovered from the raffinate for reuse and to produce a high quality raffinate. Consequently, the raffinate phase passing through line 18, is passed to raffinate stripper 52. Raffinate stripper 52 may be any convenient separation means adapted to separate organic sulfoxide from an organic raffinate, such as a fractional distillation column. The vapor phase overhead from column 52 is passed through line 54 and condensed. A portion of the condensed overhead, comprising essentially anhydrous dimethylsulfoxide, can be introduced into column 52 as a reflux through line 56. All or the remainder of the essentially anhydrous dimethylsulfoxide is recycled to extractor 12 through line 56. It is apparent, from the previous description, that substantially all of the organic sulfoxide, can be recovered from the process and reutilized in the extraction step. To the extent that makeup solvent is needed, such makeup solvent can be introduced to the system through line 58. The liquid phase from column 52 is discharged through line 60 as light cycle oil raffinate product. As previously indicated, this raffinate product is particularly useful, since it comprises a diesel fuel having a substantially improved cetane number.

While specific materials, conditions of operation, modes of operation and equipment have been referred to herein, it is to be recognized that these and other specific recitals are for illustrative purposes and to set forth the best mode only and are not to be considered limiting.

That which is claimed is:

1. A method for separating a light cycle oil to recover an aromatic and olefinic hydrocarbon fraction as an extract and a raffinate comprising diesel fuel oil, said method comprising:

(a) contacting said light cycle oil with dimethyl sulfoxide containing less than about 1 wt. % of water, under conditions sufficient to dissolve a portion of said light cycle oil in said sulfoxide to form an extract phase, comprising essentially all of said sulfoxide and said aromatic and olefinic hydrocarbon fraction, and a raffinate phase, comprising the remainder of said light cycle oil and a small amount of said sulfoxide;

(b) diluting said extract phase with water in an amount between about 4.0 and about 10.0 wt. % based on the total weight of said extract phase and said water;

(c) settling the thus diluted extract phase to produce an aqueous phase, comprising substantially all of said water and said sulfoxide, and an organic phase, comprising said aromatic and olefinic hydrocarbon fraction and minor amounts of said sulfoxide and said water;

(d) separating said aqueous phase from said organic phase by liquid-liquid separation;

(e) fractionating said organic phase, under conditions sufficient to produce a vapor phase, comprising said minor amounts of said sulfoxide and said water and a liquid phase, comprising said aromatic and olefinic hydrocarbon fraction;

(f) recycling said vapor phase to step (b);

(g) drying said aqueous phase, under conditions sufficient to remove substantially all of said water and produce a dimethyl sulfoxide containing less than about 1 wt. % of water, and;

(h) recycling said dimethyl sulfoxide produced in step (g) to step (a).

2. A method in accordance with claim 1 wherein the light cycle oil is a light cycle oil obtained by catalytically cracking petroleum oils.

3. A method in accordance with claim 1 wherein the aromatic and olefinic hydrocarbon fraction is a flotation agent.

4. A method in accordance with claim 1 wherein the raffinate phase, comprising the remainder of the light cycle oil and a small amount of the sulfoxide, is fractionated to produce a vapor phase, comprising said sulfoxide, and a liquid phase, comprising said remainder of said light cycle oil.

5. A method in accordance with claim 4 wherein the remainder of the light cycle oil is a diesel oil having an improved cetane number.

* * * * *